US007870662B2

(12) United States Patent
Imai et al.

(10) Patent No.: US 7,870,662 B2
(45) Date of Patent: Jan. 18, 2011

(54) TERMINAL INSERTION APPARATUS

(75) Inventors: Koji Imai, Kawasaki (JP); Minoru Abe, Kawasaki (JP); Jun Funakawa, Nagoya (JP); Koichi Nakajima, Handa (JP); Daisuke Toma, Handa (JP); Hirohide Miyazaki, Kariya (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 459 days.

(21) Appl. No.: 11/951,719

(22) Filed: Dec. 6, 2007

(65) Prior Publication Data

US 2008/0256792 A1 Oct. 23, 2008

(30) Foreign Application Priority Data

Dec. 14, 2006 (JP) ..... 2006-337006

(51) Int. Cl.
*H01R 43/00* (2006.01)

(52) U.S. Cl. ..... 29/748; 29/747; 29/749; 29/753; 29/755

(58) Field of Classification Search ..... 29/747–749, 29/753, 755, 837, 851, 861, 863, 876, 881, 29/33 M, 33 F
See application file for complete search history.

(56) References Cited

U.S. PATENT DOCUMENTS 5,224,251 A 7/1993 Cameron et al.
5,515,601 A 5/1996 Maejima
5,774,981 A 7/1998 Maejima
5,850,694 A 12/1998 Maejima
2002/0076990 A1 6/2002 Fujita
2002/0174537 A1 11/2002 Chujo
2009/0064491 A1 3/2009 Furuya

FOREIGN PATENT DOCUMENTS

JP 10112229 4/1998

OTHER PUBLICATIONS

Austrian Patent Office Search Report dated May 5, 2009, Application No. 200717890-8, 8 pages.
EP Search Report for corresponding EP Application No. 07 122 984.3 dated Aug. 4, 2010, 6 pages.

*Primary Examiner*—Thiem Phan
(74) *Attorney, Agent, or Firm*—Barley Snyder LLC

(57) ABSTRACT

A terminal insertion apparatus having a wire holding unit holding two wires, each wire having a terminal, a connector holding unit holding a connector housing having at least two holes for receiving terminals, and a terminal insertion head is disclosed. The terminal insertion head has a wire gripping unit having a first holder and a second holder. The first holder and second holder are movable in a vertical direction toward and away from the wire holding unit and are movable in a horizontal direction toward and away from the connector holding unit. The first holder has an outer grip and an inner grip that together hold one of the two wires while the second holder has an outer grip and an inner grip that together hold the remaining of the two wires.

9 Claims, 5 Drawing Sheets

TERMINAL INSERTION APPARATUS

CROSS-REFERENCE TO RELATED APPLICATION DATA

This application claims the benefit of the earlier filed Japanese Patent Application No. 2006-337006 having a filing date of Dec. 14, 2006.

FIELD OF THE INVENTION

The present invention relates to a terminal insertion apparatus.

BACKGROUND

The terminal insertion apparatus described in Prior Art FIG. 5 (see JP10-112229A), for example, is a terminal insertion apparatus which inserts a terminal attached to an electrical wire into a terminal insertion hole of a connector housing during the production of a wire harness.

Prior Art FIG. 5 is a side view of a terminal insertion apparatus according to JP10-112229A. Prior Art FIG. 6 is a side view showing a terminal insertion head provided in the terminal insertion apparatus shown in Prior Art FIG. 5.

The terminal insertion apparatus 50 shown in Prior Art FIG. 5 comprises a pair of X-axis beams 52 installed on frames 51, a Y-axis beam 53 supported on the respective X-axis beams 52 in a movable manner, a terminal insertion head 54 capable of moving along the Y-axis beam 53, and a connector gripping unit 55 similarly capable of moving along the Y-axis beam 53.

As is shown in Prior Art FIG. 5, the terminal insertion head 54 is attached to the rail 57 of the Y-axis beam 53 in a movable manner via a linear motion guide (LM guide) 56.

As is shown in Prior Art FIGS. 5 and 6, the terminal insertion head 54 comprises a frame 58 fastened to the linear motion guide 56, a first base plate part 60 attached to the frame 58 via a ball screw unit 59 so as to be freely raised and lowered, and a second base plate part 62 attached to the first base plate part 60 via a vertical cylinder 61 so as to be freely raised and lowered.

An electrical wire separation unit 63 is installed at the front end of the first base plate part 60. Furthermore, a terminal gripping unit 64 is installed on the second base plate part 62.

The electrical wire separation unit 63 comprises a pair of electrical wire separation claws 65 capable of opening and closing in the left-right direction (depth direction in Prior Art FIGS. 5 and 6), and a chuck cylinder 66 that causes the electrical wire separation claws 65 to open and close.

The terminal gripping unit 64 comprises a pair of front-side electrical wire gripping hands 68, a pair of rear-side electrical wire gripping hands 69, a first chuck cylinder 70 that causes the front-side electrical wire gripping hands 68 to open and close in the left -right direction, and a second chuck cylinder 71 that causes the rear-side electrical wire gripping hands 69 to open and close in the left-right direction. Moreover, the terminal gripping unit 64 comprises a first horizontal cylinder 72 that causes the entire terminal gripping unit 64 to advance and retract, and a second horizontal cylinder 73 that causes only the rear-side electrical wire gripping hands 69 to advance and retract.

When the terminal C attached to each electrical wire W is to be inserted into a terminal insertion hole of a connector housing 67 by means of the terminal insertion apparatus 50, the ball screw unit 59 first lowers the terminal insertion head 54, and the vertical cylinder 61 lowers the two sets of electrical wire gripping hands 68 and 69. Then, the two sets of electrical wire gripping hands 68 and 69 grip the terminal of an electrical wire W that is set in an electrical wire clip 74.

Next, the ball screw unit 59 raises the entire terminal insertion head 54, and the vertical cylinder 61 raises the two sets of electrical wire gripping hands 68 and 69. Then, the terminal insertion head 54 moves along the Y-axis beam 53 so as to be above the connector housing 67 that is gripped by the connector gripping unit 55.

Furthermore, the ball screw unit 59 again lowers the terminal insertion head 54, thus causing the electrical wire separation claws 65 of the electrical wire separation unit 63 to be inserted between lead electrical wires (not shown in the figures) that are led out from the connector housing 67. Moreover, the chuck cylinder 66 opens the electrical wire separation claws 65, so that a state is created in which the lead electrical wires are separated.

Afterward, the first horizontal cylinder 72 on the upper side causes the two sets of electrical wire gripping hands 68 and 69 to advance integrally with the second base plate part 62. As a result, the terminal C is temporarily inserted into a terminal insertion hole of the connector housing 67.

Then, the front-side electrical wire gripping hands 68 are opened, the second horizontal cylinder 73 is extended, and the electrical wire W is pushed only by the rear-side electrical wire gripping hands 69. As a result, the terminal C is completely inserted into the terminal insertion hole of the connector housing 67.

Because lead electrical wires of terminals C that have already been inserted into terminal insertion holes of the connector housing 67 can be separated using such a terminal insertion apparatus 50, it is possible to reliably perform the insertion of each terminal C into a terminal insertion hole of the connector housing 67.

However, in the terminal insertion apparatus 50 shown in Prior Art FIGS. 5 and 6, it is necessary to perform the insertion of terminals C attached to electrical wires W into terminal insertion holes of the connector housing 67 for one terminal at a time for each electrical wire W during the production of a wire harness. Accordingly, it is difficult to increase the wire harness production efficiency.

SUMMARY

The present invention, in one embodiment, relates to a terminal insertion apparatus having a wire holding unit holding two wires, each wire having a terminal, a connector holding unit holding a connector housing having at least two holes for receiving terminals, and a terminal insertion head. The terminal insertion head has a wire gripping unit having a first holder and a second holder. The first holder and second holder are movable in a vertical direction toward and away from the wire holding unit and are movable in a horizontal direction toward and away from the connector holding unit. The first holder has an outer grip and an inner grip that together hold one of the two wires while the second holder has an outer grip and an inner grip that together hold the remaining of the two wires.

BRIEF DESCRIPTION OF THE DRAWINGS

Prior Art

DETAILED DESCRIPTION OF THE EMBODIMENTS

A terminal insertion apparatus of an embodiment of the present invention will be described below with reference to the figures. For the convenience of description, the terminal guides and the like are omitted in FIG. 1.

Figure 1:
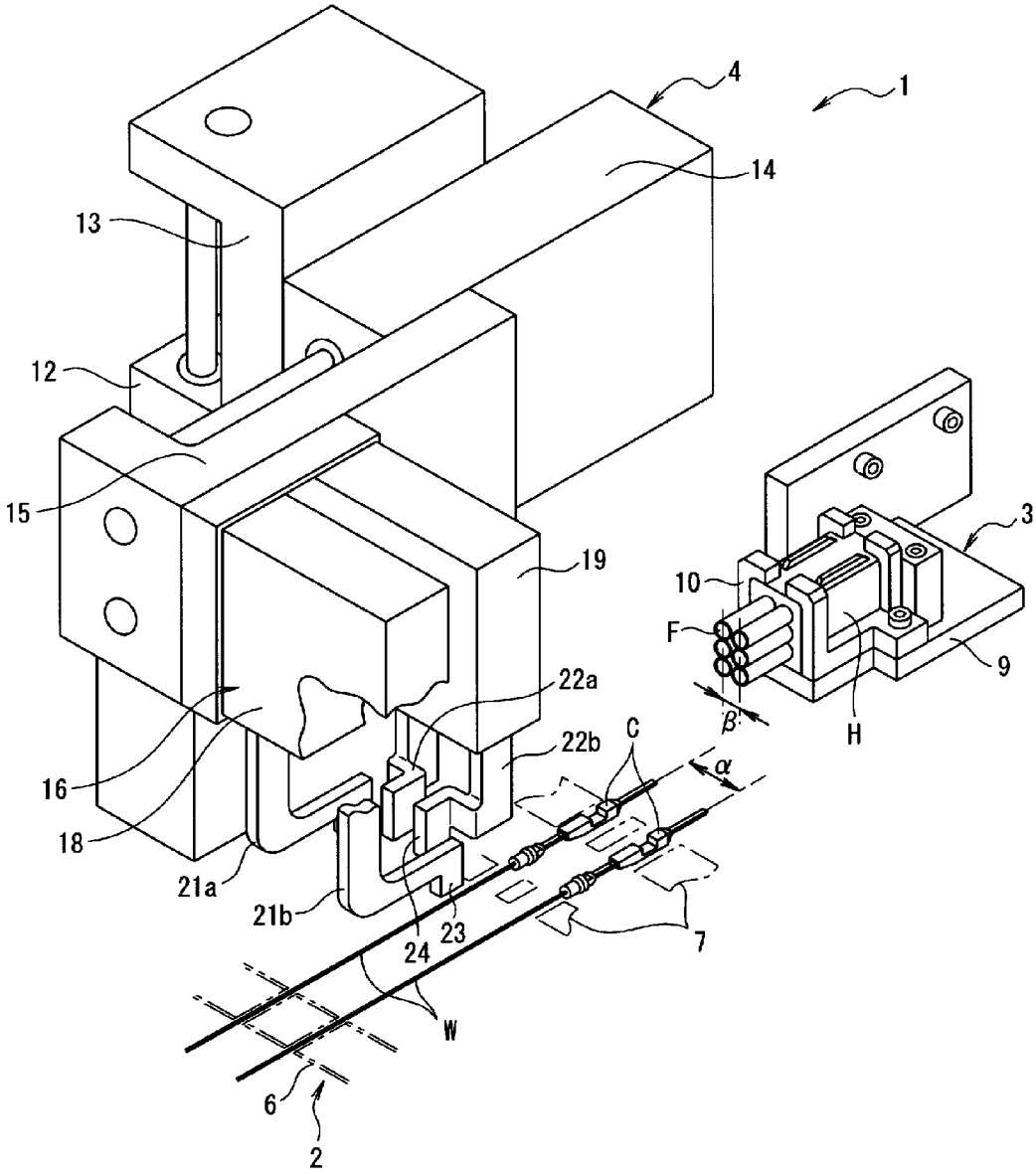
FIG. 1 is an oblique schematic view of the essential parts of a terminal insertion apparatus according to an embodiment of the present invention.

The terminal insertion apparatus 1 shown in FIG. 1 is used to insert terminals C attached to one end of electrical wires W into terminal insertion holes F of a connector housing H during wire harness production.

Figure 2:
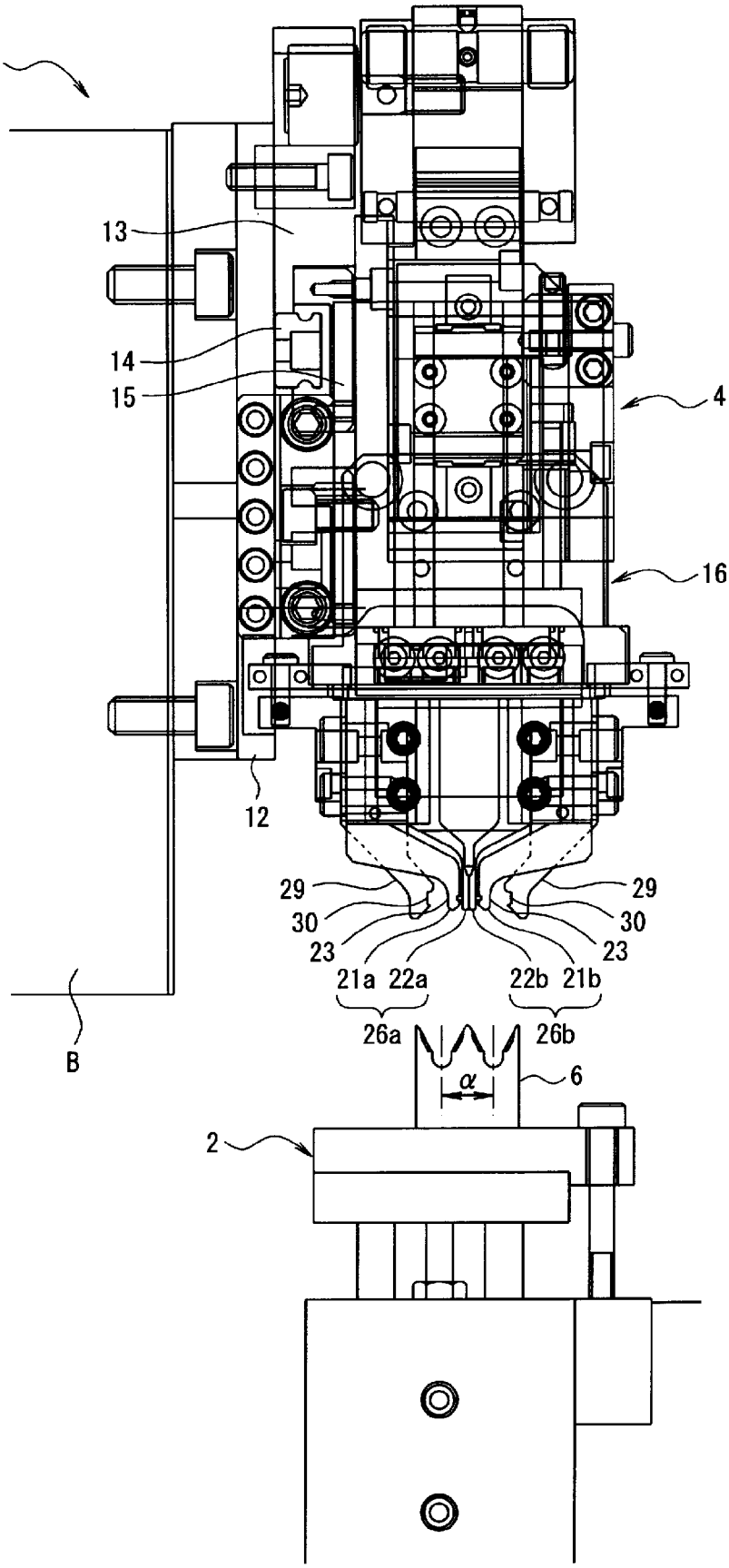
FIG. 2 is an orthogonal front view of the terminal insertion apparatus of FIG. 1.
Figure 3:
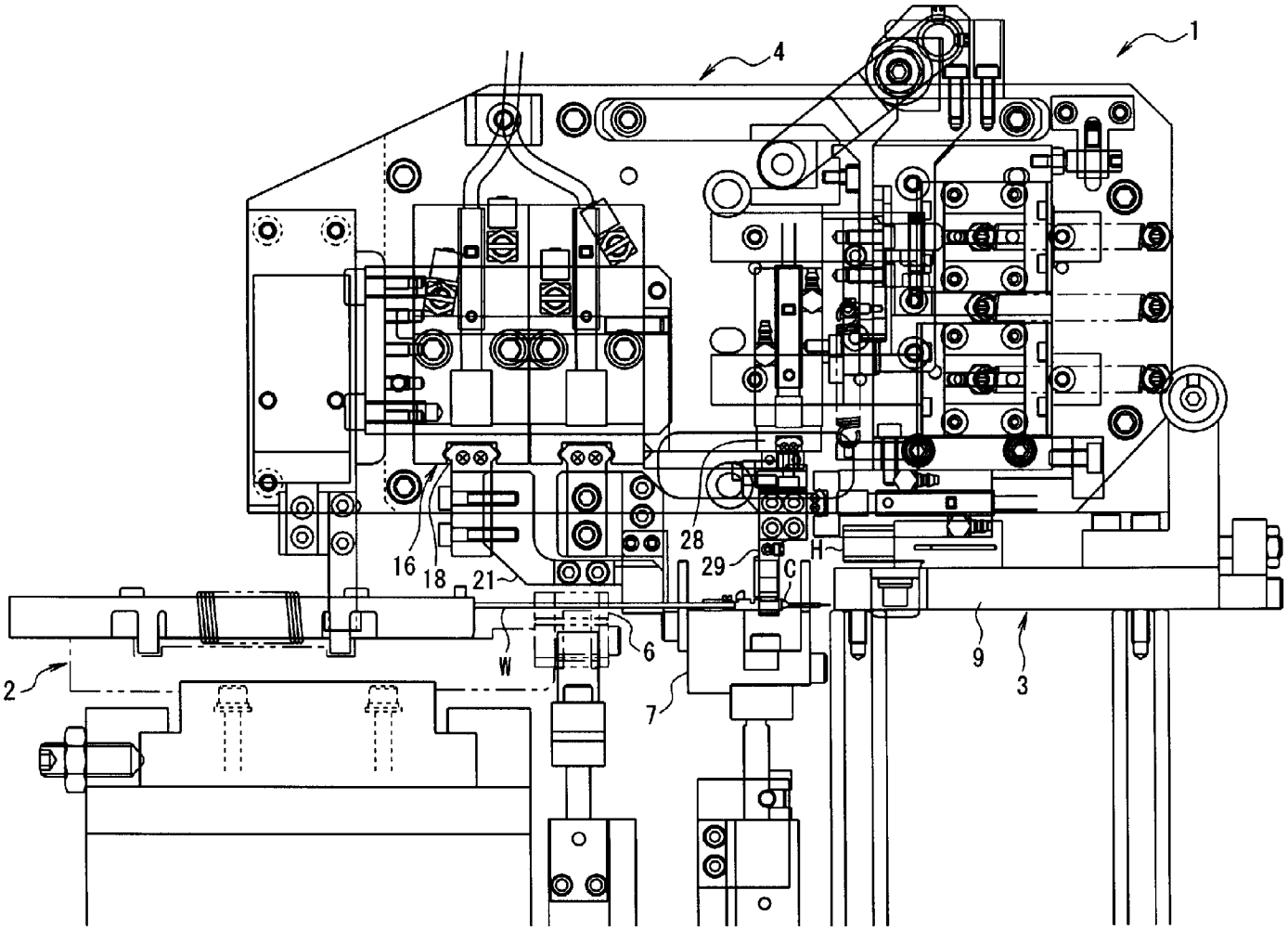
FIG. 3 is an orthogonal side view of the terminal insertion apparatus of FIG. 1.

As is shown in FIGS. 1 through 3, the terminal insertion apparatus 1 comprises an electrical wire supporting unit 2 arranged on the surface of a base (not shown in the figures), a connector holding unit 3 similarly arranged on the surface of the base, and a terminal insertion head 4 attached to a side wall B that is vertically installed on the base.

The electrical wire supporting unit 2 comprises a clamp 6 for holding electrical wires W, and a carrier 7 for carrying terminals C that are attached to the electrical wires W.

The clamp 6 can hold a plurality of electrical wires W (two electrical wires in the present embodiment) at a specified wire separation distance α (approximately 8 mm in the present embodiment, for example). Furthermore, in cases where the specified wire separation distance α of the electrical wires W held by the clamp 6 is set at 8 mm, this wire separation distance α is a relatively narrow distance for clamp provided in automated apparatuses of this type.

The connector holding unit 3 comprises a baseplate 9 on which the connector housing H is carried, and a lock 10 for locking the connector housing H carried on the baseplate 9.

The terminal insertion head 4 comprises a vertical mount 13 attached to the side wall B via a vertical actuator 12 so as to be freely raised and lowered, a horizontal mount 15 attached to the vertical mount 13 via a horizontal actuator 14 so as to be freely moved horizontally, and an electrical wire gripping unit 16 attached to the horizontal mount 15. In this embodiment, the vertical actuator 12 and horizontal actuator 14 each comprise an air cylinder or are otherwise pneumatic. However, in alternative embodiments of the present invention, any other suitable actuation device may be substituted for the air cylinders.

The electrical wire gripping unit 16 comprises a pair of first and second outer claws 21*a*, 21*b* opened and closed by an outer chuck 18 and a pair of first and second inner claws 22*a*, 22*b* opened and closed by an inner chuck 19. The outer chuck 18 and inner chuck 19 are attached to the horizontal mount 15.

Figure 4:
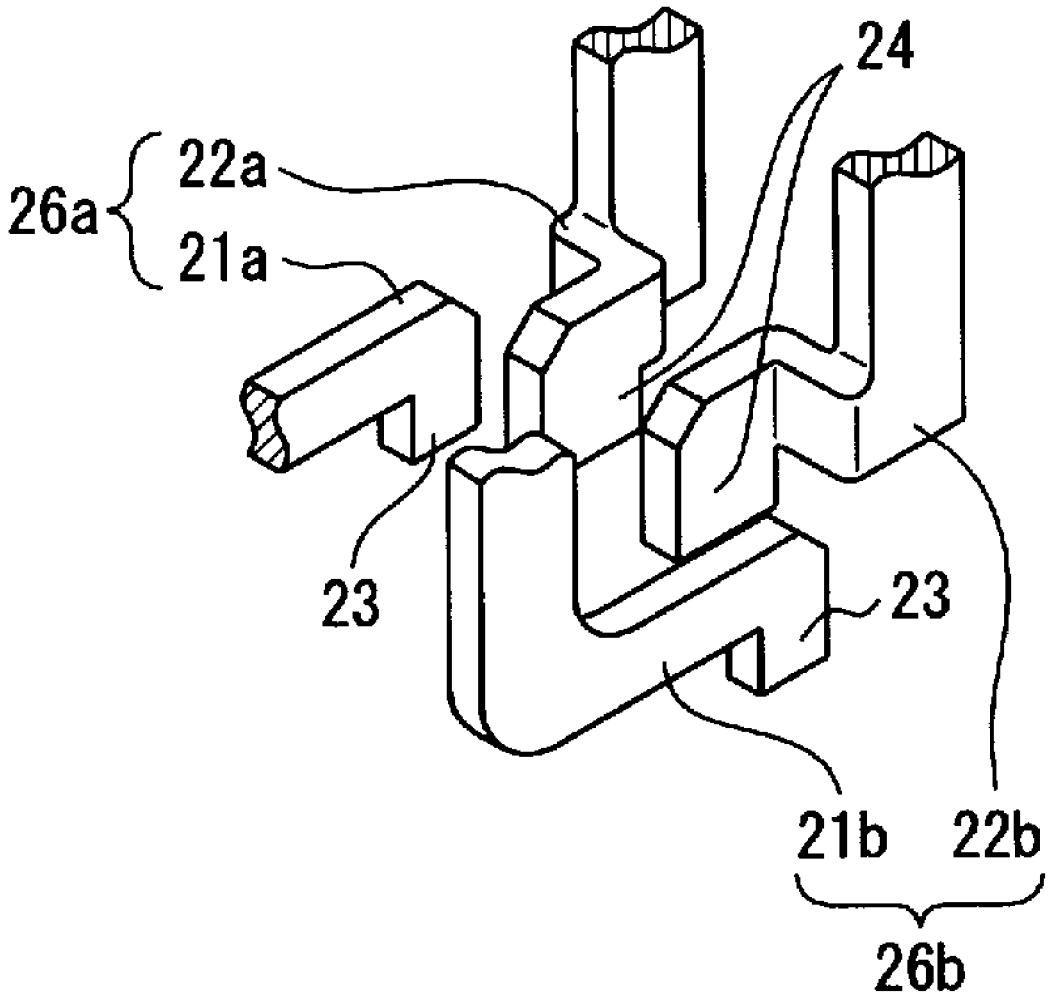
FIG. 4 is an oblique schematic view of a chuck of the terminal insertion apparatus of FIG. 1.
Figure 5:
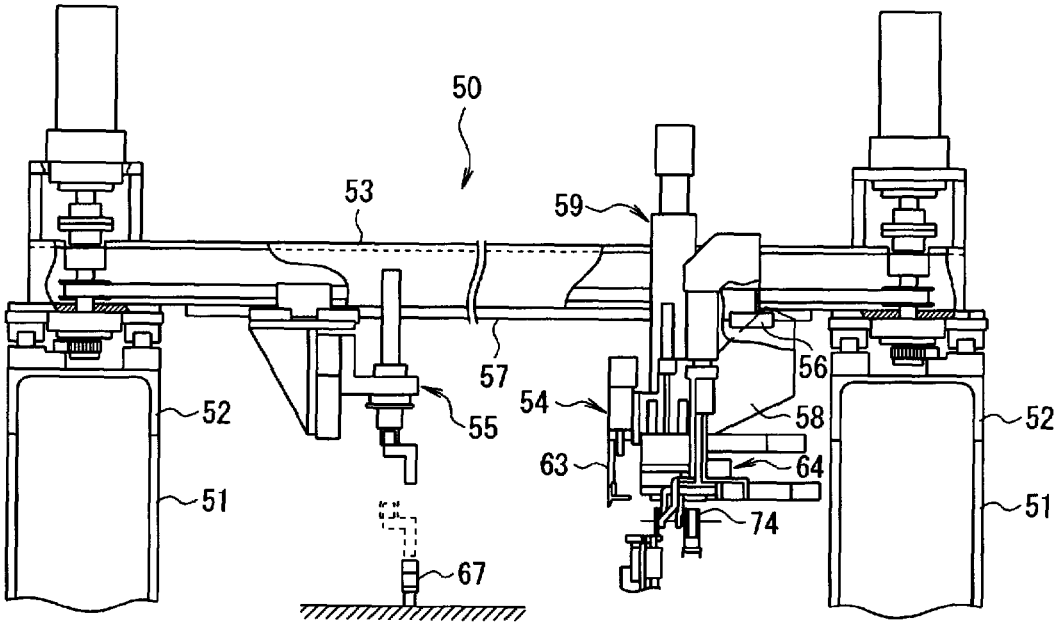
F I G. 5 PRIOR ART
FIG. 5 is an orthogonal side view of a terminal insertion apparatus of JP10-112229A; and Prior Art
Figure 6:
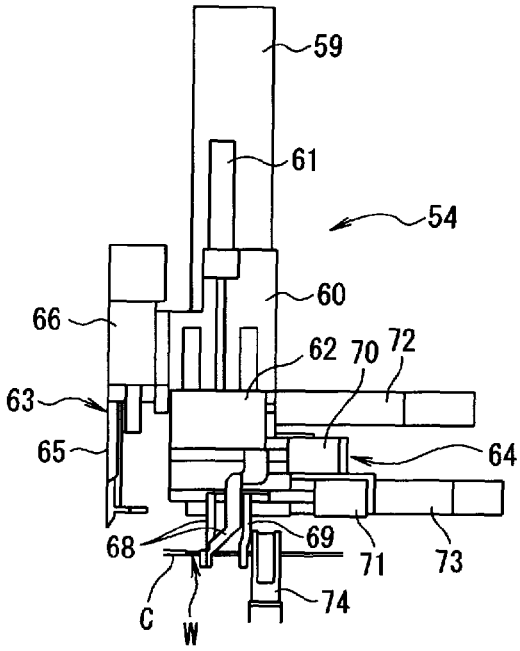
F I G. 6 PRIOR ART
FIG. 6 is an orthogonal side view of a terminal insertion head of the terminal insertion apparatus of Prior Art FIG. 5.

As is shown in FIG. 4, each of the first and second outer claws 21*a*, 21*b* is formed substantially in the shape of the letter "L" as seen from the left-right direction (left-right direction in FIGS. 1 and 4). Outer grips 23 that protrude downward in the vertical direction (vertical direction in FIGS. 1 and 4) are respectively provided at the tip end portions of the first and second outer claws 21*a*, 21*b*.

Each of the first and second inner claws 22*a*, 22*b* is formed substantially in the shape of the letter "L" as seen from the left-right direction as shown in FIG. 4. Inner grips 24 that protrude downward in the vertical direction are respectively provided at the tip end portions of the first and second inner claws 22*a*, 22*b*.

In the electrical wire gripping unit 16, the inner grips 24 of the first and second inner claws 22*a*, 22*b* are arranged between the outer grips 23 of the first and second outer claws 21*a*, 21*b*. In the electrical wire gripping unit 16, furthermore, the first and second inner claws 22*a*, 22*b* and first and second outer claws 21*a*, 21*b* are arranged so that the inner grips 24 of the first and second inner claws 22*a*, 22*b* and the outer grips 23 of the first and second outer claws 21*a*, 21*b* overlap as seen from the left-right direction. Moreover, in the initial state of the electrical wire gripping unit 16, the first and second inner claws 22*a*, 22*b* are arranged with a specified distance in the left-right direction as shown in FIGS. 1 and 4 so as to allow the gripping of the two electrical wires W arranged at the specified wire separation distance α.

Furthermore, the first outer claw 21*a* and first inner claw 22*a* (together on the same side) make up a first holder 26*a*. The first holder 26*a* grips one of the electrical wires W with the inner surface of the outer grips 23 of the first outer claw 21*a* and the outer surface of the inner grips 24 of the first inner claw 22*a*.

Moreover, the second outer claw 21*b* and the second inner claw 22*b* (together on an opposite side) make up a second holder 26*b*. The second holder 26*b* grips the other electrical wire W with the inner surface of the outer grips 23 of the second outer claw 21*b* and the outer surface of the inner grips 24 of the second inner claw 22*b*.

With regard to the first holder 26*a* and second holder 26*b*, the outer chuck 18 causes the first and second outer claws 21*a*, 21*b* to move outward, and the inner chuck 19 causes the first and second inner claws 22*a*, 22*b* to move inward, so that the sets of outer and inner grips 23, 24 of the respective first and second holders 26*a*, 26*b* are placed in an open state.

With regard to the first holder 26*a* and second holder 26*b*, furthermore, the outer chuck 18 causes the first and second outer claws 21*a*, 21*b* to move inward, and the inner chuck 19 causes the first and second inner claws 22*a*, 22*b* to move outward, so that the sets of outer and inner grips 23, 24 of the respective first and second holders 26*a*, 26*b* are placed in a closed state.

Thus, the electrical wire gripping unit 16 makes it possible to grip or release the electrical wires W between the sets of outer and inner grips 23, 24 of the respective holders 26*a*, 26*b* by opening or closing the sets of outer and inner grips 23, 24 of the respective holders 26*a*, 26*b*.

In the first and second holders 26*a*, 26*b* that are in a state in which the outer and inner grips 23, 24 are closed, the outer chuck 18 causes the first and second outer claws 21*a*, 21*b* to move further inward, so that the first and second outer claws 21*a*, 21*b* press the first and second inner claws 22*a*, 22*b* inward, thus reducing the distance between the first and second inner claws 22*a*, 22*b*. As a result, it is possible to move the outer and inner grips 23, 24 of the first and second holders 26*a*, 26*b* inward in the direction of arrangement of the first and second holders 26*a*, 26*b* (left-right direction in FIG. 1). Consequently, the electrical wire gripping unit 16 can change the wire separation distance α of the two electrical wires W gripped by the outer and inner grips 23, 24 of the first and second holders 26*a*, 26*b* to a smaller distance.

In the first and second holders 26*a*, 26*b* that are in a state in which the outer and inner grips 23, 24 are closed, the inner chuck 19 causes the first and second inner claws 22*a*, 22*b* to move further outward, so that the first and second inner claws 22*a*, 22*b* press the first and second outer claws 21*a*, 21*b* outward, thus increasing the distance between the first and second inner claws 22*a*, 22*b*. As a result, it is possible to move the outer and inner grips 23, 24 of the first and second holders 26*a*, 26*b* outward in the direction of arrangement of the first and second holders 26*a*, 26*b*. Consequently, the electrical wire gripping unit 16 can change the wire separation distance α of the two electrical wires W gripped by the outer and inner grips 23, 24 of the first and second holders 26*a*, 26*b* to a larger distance.

Thus, the first holder 26*a* and second holder 26*b* can change the wire separation distance α of the two electrical wires W gripped by the outer and inner grips 23, 24 of the first and second holders 26*a*, 26*b* from the specified wire separation distance α, at which these electrical wires W have been held by the clamp 6 to an terminal hole separation distance β at which the terminals C attached to the electrical wires W that are gripped by the outer and inner grips 23, 24 of the first and second holders 26*a*, 26*b* can be simultaneously inserted into specified terminal insertion holes F of the connector housing H.

In this case, by causing the inner surface of the first inner claw 22*a* of the first holder 26*a* and the inner surface of the second inner claw 22*b* of the second holder 26*b* to contact each other as shown in FIG. 2, the wire separation distance of the two electrical wires W gripped by the outer and inner grips 23, 24 of these first and second holders 26*a*, 26*b* is set at the terminal hole separation distance β (3 mm in the present embodiment, for example), which allows the simultaneous insertion of the terminals C attached to the electrical wires W that are gripped by the outer and inner grips 23, 24 of the first and second holders 26*a*, 26*b* into specified terminal insertion holes F of the connector housing H.

Furthermore, in the first and second holders 26*a*, 26*b* that are in a state in which the first and second inner claws 22*a*, 22*b* contact each other, the distance between the first and second inner claws 22*a*, 22*b* is returned to the specified distance described above by the outer chuck 18 causing the first and second outer claws 21*a*, 21*b* to move outward.

Moreover, as is shown in FIGS. 2 and 3, the electrical wire gripping unit 16 is provided with a pair of terminal guides 29 that are opened and closed by a terminal guide actuator 28. The terminal guide actuator 28 is attached to the horizontal mount 15. In this embodiment, the terminal guide actuator comprises an air cylinder or is otherwise pneumatic. However, in alternative embodiments, any suitable actuator may be substituted for the air cylinder.

Recesses 30 that can support the terminals C attached to the electrical wires W are respectively formed on the inside of the lower end portions of these terminal guides 29. The recesses 30 of the respective terminal guides 29 support the outside of the respective terminals C carried on the carrier 7.

Next, actions that are taken when the terminals C attached to the electrical wires W are inserted into terminal insertion holes F of the connector housing H by the terminal insertion apparatus 1 will be described.

When the terminals C attached to the electrical wires W are to be inserted into terminal insertion holes F of the connector housing H by means of the terminal insertion apparatus 1, the two electrical wires W to which the terminals C have been crimped beforehand in a previous step are first set in the electrical wire supporting unit 2. In this case, the respective electrical wires W are held by the clamp 6, and the terminals C attached to the respective electrical wires W are placed on the carrier 7. Here, the wire separation distance α of the two electrical wires W held by the clamp 6 is set at 8 mm.

Furthermore, the connector housing H is set in the connector holding unit 3. In this case, the connector housing H is carried on the baseplate 9, and the connector housing H carried on the baseplate 9 is locked by the lock 10.

Here, in the electrical wire gripping unit 16 that is in the initial state, the first and second outer claws 21*a*, 21*b* are arranged in a state in which these outer claws are moved outward, and the first and second inner claws 22*a*, 22*b* are arranged in a state in which these inner claws are moved inward, so that the outer and inner grips 23, 24 of the respective first and second holders 26*a*, 26*b* are placed in a mutually open state.

Moreover, in the electrical wire gripping unit 16 that is in the initial state, the first and second inner claws 22*a*, 22*b* assume a state in which these inner claws are arranged with a specified distance in the left-right direction so that these inner claws can grip the two electrical wires W that are arranged at the specified wire separation distance α.

In addition, in the electrical wire gripping unit 16 that is in the initial state, the two terminal guides 29 are in a mutually open state by being arranged in a state in which these terminal guides are moved outward.

Then, the vertical actuator 12 lowers the electrical wire gripping unit 16 that is in the initial state. As a result, the outer and inner grips 23, 24 of the respective first and second holders 26*a*, 26*b* are respectively disposed on the outside and on the inside of the individual electrical wires W that are held by the clamp 6. At the same time, furthermore, the respective terminal guides 29 are disposed on the outside of the respective terminals C that are carried on the carrier 7.

Next, the outer chuck 18 causes the first and second outer claws 21*a*, 21*b* to move inward, and the inner chuck 19 causes the first and second inner claws 22*a*, 22*b* to move outward. As a result, the outer and inner grips 23, 24 of the respective first and second holders 26*a*, 26*b* grip the respective electrical wires W.

Moreover, the terminal guide actuator 28 causes the two terminal guides 29 to move inward. Consequently, the recesses 30 of the respective terminal guides 29 support the terminals C attached to the respective electrical wires W.

Next, the vertical actuator 12 raises the electrical wire gripping unit 16. As a result, positioning in the vertical direction is performed between the terminals C attached to the electrical wires W that are gripped by the outer and inner grips 23, 24 of the respective first and second holders 26*a*, 26*b* and specified terminal insertion holes F of the connector housing H disposed in the connector holding unit 3. In this case, the wire separation distance of the electrical wires W that are gripped by the outer and inner grips 23, 24 of the first and second holders 26*a*, 26*b* of the electrical wire gripping unit 16 is still the wire separation distance α, at which these two electrical wires W have been held by the clamp 6.

Then, the chuck 18 causes the first and second outer claws 21*a*, 21*b* to move further inward, thus causing the inner surface of the first inner claw 22*a* of the first holder 26*a* and the inner surface of the second inner claw 22*b* of the second holder 26*b* to contact each other. This changes the wire separation distance of the two electrical wires W that are gripped by the outer and inner grips 23, 24 of the first and second holders 26*a*, 26*b* to 3 mm, which is the terminal hole separation distance β for allowing the simultaneous insertion of the terminals C attached to these two electrical wires W into specified terminal insertion holes F of the connector housing H. In this case, in synchronization with the change in the wire separation distance of the electrical wires W gripped by the outer and inner grips 23, 24 of the first and second holders 26*a* and 26*b*, the terminal guide actuator 28 causes the two terminal guides 29 to move further inward, thus causing these terminal guides 29 to continue to support the terminals C attached to the respective electrical wires W.

Furthermore, the horizontal actuator 14 causes the electrical wire gripping unit 16 to advance toward the connector housing H that is disposed in the connector holding unit 3. As a result, the terminals C attached to the two electrical wires W that are gripped by the outer and inner grips 23, 24 of the respective first and second holders 26*a*, 26*b* are simultaneously inserted into specified terminal insertion holes F of the connector housing H in a temporary manner.

Following the temporary insertion of the terminals C into the terminal insertion holes F, the terminal guide actuator 28 causes the two terminal guides 29 to move outward. This releases the support of the terminals C attached to the respective electrical wires W by means of the respective terminal guides 29.

Then, the horizontal cylinder 14 causes the electrical wire gripping unit 16 to advance further toward the connector housing H. As a result, the terminals C attached to the respective electrical wires W are completely inserted into the specified terminal insertion holes F of the connector housing H.

Furthermore, following the insertion of the terminals C attached to the respective electrical wires W into the specified terminal insertion holes F of the connector housing H, the gripping of the electrical wires W by the outer and inner grips 23, 24 of the respective first and second holders 26*a*, 26*b* is released.

Moreover, the electrical wire gripping unit 16 is returned to the initial state and prepared for insertion of subsequent electrical wires W.

Thus, during wire harness production, the terminal insertion apparatus 1 enables the insertion of the terminals C attached to electrical wires W into terminal insertion holes F of the connector housing H for two electrical wires W at the same time.

Here, when gripping two electrical wires W and changing the wire separation distance of these two gripped electrical wires W, it is ordinarily necessary to use a total of three drive systems, i.e., drive systems that respectively drive two gripping means for gripping the individual electrical wires W and a drive system that moves these two gripping means. However, in the electrical wire gripping unit 16 of the terminal insertion apparatus 1, the first chuck 18 and second chuck 19 perform the gripping of two electrical wires W by means of the respective first and second holders 26*a*, 26*b* and the changing of the wire separation distance of these two electrical wires W. That is, the terminal insertion apparatus 1 makes it possible to grip two electrical wires and to change the wire separation distance of the two gripped electrical wires by using only two sets of drive systems.

In addition, with the terminal insertion apparatus 1, as a result of the recesses 30 of the respective terminal guides 29 supporting the terminals C attached to the respective electrical wires W, it is possible to prevent the occurrence of positional deviation between the terminals C and terminal insertion holes F when the terminals C attached to the electrical wires W are inserted into the terminal insertion holes F of the connector housing H.

The present invention performs the insertion of terminals C attached to electrical wires W into terminal insertion holes F of the connector housing H for two electrical wires at the same time during wire harness production. The present invention also provides that the gripping of two electrical wires W and the changing of the wire separation distance $\alpha$ of the two electrical wires W can be performed using two sets of drive systems. Further, because the terminal guides 29 that support the terminals C attached to the electrical wires W are provided, the present invention makes it is possible to prevent the occurrence of positional deviation between the terminals C and terminal insertion holes F when the terminals C attached to the electrical wires W are inserted into the terminal insertion holes F of the connector housing H.

What is claimed is:

1. A terminal insertion apparatus, comprising:

a wire holding unit holding two wires, each wire having a terminal;

a connector holding unit holding a connector housing having at least two holes for receiving terminals;

a terminal insertion head having a wire gripping unit comprising: a first holder; a second holder; a vertical actuator; a horizontal actuator moving the first holder and the second holder in a horizontal direction; a horizontal mount attached to the horizontal actuator; and a vertical mount attached to the vertical actuator and carrying the horizontal actuator and the horizontal mount; the first holder and second holder being movable in a vertical direction toward and away from the wire holding unit, and the first holder and second holder being movable in the horizontal direction toward and away from the connector holding unit, the first holder comprising an outer grip and an inner grip that together hold one of the two wires and the second holder comprising an outer grip and an inner grip that together hold the remaining of the two wires;

an outer chuck carried by the horizontal mount;

an inner chuck carried by the horizontal mount;

a first outer claw carried by the outer chuck;

a second outer claw carried by the outer chuck;

wherein the outer chuck moves the first outer claw toward and away from the second outer claw and wherein the outer chuck moves the second outer claw toward and away from the first outer claw;

a first inner claw carried by the inner chuck and disposed between the first outer claw and the second outer claw; and a second inner claw carried by the inner chuck and disposed between the second outer claw and the first inner claw;

wherein the inner chuck moves the first inner claw toward and away from the second inner claw and wherein the inner chuck moves the second inner claw toward and away from the first inner claw.

2. The terminal insertion apparatus according to claim 1, wherein each of the first outer claw and the second outer claw comprise a substantially L-shaped profile and a downwardly protruding outer grip while each of the first inner claw and the second inner claw comprise a substantially L-shaped profile and a downwardly protruding inner grip.

3. The terminal insertion apparatus according to claim 2, wherein when the first inner claw and the second inner claw abut against each other while the first holder and the second holder each hold one of the two wires, a wire separation distance is equal to a terminal hole separation distance between the at least two holes.

4. The terminal insertion apparatus according to claim 3, wherein the terminal hole separation distance is equal to about 3 mm.

5. The terminal insertion apparatus according to claim 3, wherein the wire separation distance between the at least two wires while the at least two wires are held by the holding unit is not equal to the terminal hole separation distance.

6. The terminal insertion apparatus according to claim 3, wherein the wire separation distance between the at least two wires while the at least two wires are held by the holding unit is equal to about 8 mm.

7. The terminal insertion apparatus according to claim 1, the wire gripping unit further comprising:

a plurality of terminal guides that are opened and closed by a terminal guide actuator.

8. The terminal insertion apparatus according to claim 7, each of the terminal guides comprising a recess that supports an outside of the terminals carried by the terminal guides.

9. The terminal insertion apparatus according to claim 8, wherein the terminal guides selectively support the terminals.

* * * * *